United States Patent [19]

Feagle

[11] 4,428,583

[45] Jan. 31, 1984

[54] AIRBORNE TARGET FOR GENERATING AN EXHAUST PLUME SIMULATING THAT OF A JET POWERED AIRCRAFT

[75] Inventor: Hugh B. Feagle, Leeds, Ala.

[73] Assignee: Hayes International Corporation, Birmingham, Ala.

[21] Appl. No.: 443,056

[22] Filed: Nov. 19, 1982

[51] Int. Cl.[3] ..... F41J 9/08; F41J 9/10

[52] U.S. Cl. ..... 273/348.1

[58] Field of Search ..... 273/359–365, 273/348.1

[56] References Cited

U.S. PATENT DOCUMENTS 3,410,559 11/1968 Miller, Jr. et al. ..... 273/360

FOREIGN PATENT DOCUMENTS 699968 12/1964 Canada ..... 273/360

*Primary Examiner*—Paul E. Shapiro

*Attorney, Agent, or Firm*—Woodford R. Thompson, Jr.

[57] ABSTRACT

An airborne target for generating an exhaust plume simulating that of a jet powered aircraft embodies an elongated target body having an elongated combustion chamber therein. An air receiving inlet which faces in the direction of travel of the body communicates with the forwardmost end of the combustion chamber. An expansion chamber between the air receiving inlet and combustion chamber increases the expansion of air flowing toward the combustion chamber while at the same time reduces its velocity. A fuel injector is carried by the body to inject hydrocarbon fuel at a predetermined rate under pressure into the air to thus provide a predetermined fuel-air mixture. An igniter is carried by the body downstream of the fuel injector to ignite the fuel-air-mixture. A flame holder is carried by the body in position for the ignited fuel-air mixture to attach thereto and provide sustained burning after the igniter is spent. The sustained burning of the mixture thus produces an exhaust plume of a predetermined length which simulates the same spectral distribution of infrared energy as that produced from a jet engine burning the same fuel.

8 Claims, 9 Drawing Figures

AIRBORNE TARGET FOR GENERATING AN EXHAUST PLUME SIMULATING THAT OF A JET POWERED AIRCRAFT

BACKGROUND OF THE INVENTION

This invention relates to an airborne target for use in simulating the exhaust plume of jet powered aircraft and more particularly to an improved airborne target having an infrared plume generator which may be employed during training and weapons evaluation exercises involving the use of infrared guided weapons designed to home on the infrared rich content of the exhaust plume of a jet powered aircraft.

Heretofore in the art to which my invention relates, many infrared emitting airborne targets have been employed by military agencies in the support of infrared guided weaponry exercises. Such targets were designed to simulate the black or gray body infrared energy emitted by the engine of a jet aircraft. The infrared guided weapons used to intercept the target have guidance systems which utilize infrared detectors that sense the short wavelength radiation produced by the metal parts in the exhaust region that comprise and are adjacent the jet engine. These type guidance systems require that the launch aspect angle of the infrared missile be restricted to the tail sector of the airborne target in order to place the hot metal radiators of the engine in the missile's field-of-view. Improvements in infrared detectors increased their capability to sense longer wavelength infrared energy; therefore, infrared guided weapons were designed to home on the longer wavelength energy found in the infrared rich content of the exhaust plume of a jet powered aircraft. Since this exhaust plume would extend many feet beyond the engine exhaust opening, it could be seen by the newer infrared guided weapons from virtually any given angle. This would permit the latest infrared weapons to be launched from any aspect angle which is in direct contrast to earlier infrared weapons which were designed to be launched from limited aspect angles.

SUMMARY OF THE INVENTION

In accordance with my present invention, I overcome the above and other difficulties by providing an improved airborne target which generates an infrared rich exhaust plume that simulates the exhaust plume of a jet powered aircraft.

It is an object of my invention to provide an improved airborne target which produces an exhaust plume that achieves substantially zero thrust while at the same time burns the same or similar hydrocarbon fuel as conventional jet engines to produce infrared energy in the same spectral bands as that produced by the exhaust plume of a jet powered aircraft.

Another object of my invention is to provide an improved airborne target wherein the fuel-air mixture burned therein may be easily adjusted to vary the length of the plume generated and the wavelengths of visible and infrared energy produced.

Still another object of my invention is to provide an improved airborne target which may be employed by military agencies in the use of improved infrared guided weapons which may be launched from any aspect angle and are designed to home on the longer wavelengths of infrared energy produced by exhaust plumes of jet powered aircraft.

Yet another object of my invention is to provide an improved airborne target which may be carried by a drone plane or towed from a manned aircraft to provide an expendible and inexpensive means for military agencies to exercise high technology infrared guided weapons.

My improved airborne target for generating an exhaust plume simulating that of a jet powered aircraft comprises an elongated target body carrying a longitudinally extending combustion chamber and having an air receiving inlet which faces the direction of travel of the body and communicates with the forwardmost end of the combustion chamber. An expansion chamber is provided between the air receiving inlet and the forwardmost end of the combustion chamber to increase the expansion of a stream of air flowing therethrough and to reduce the velocity thereof. A fuel injector is carried by the body in position to inject hydrocarbon fuel at a predetermined rate into the stream of air to thus provide a predetermined fuel-air mixture. At least one igniter is carried by the body downstream of the fuel injector to ignite the fuel-air mixture. A flame holder is carried by the body in position for the ignited fuel-air mixture to attach thereto and provide sustained burning of the mixture after the igniter is spent thus producing an exhaust plume of a predetermined length which simulates the same spectral distribution of infrared energy as that produced from a jet engine burning the same hydrocarbon fuel.

DESCRIPTION OF THE DRAWINGS

An airborne target embodying features of my invention is illustrated in the accompanying drawings, forming a part of this application, in which.

DETAILED DESCRIPTION

Figure 1:
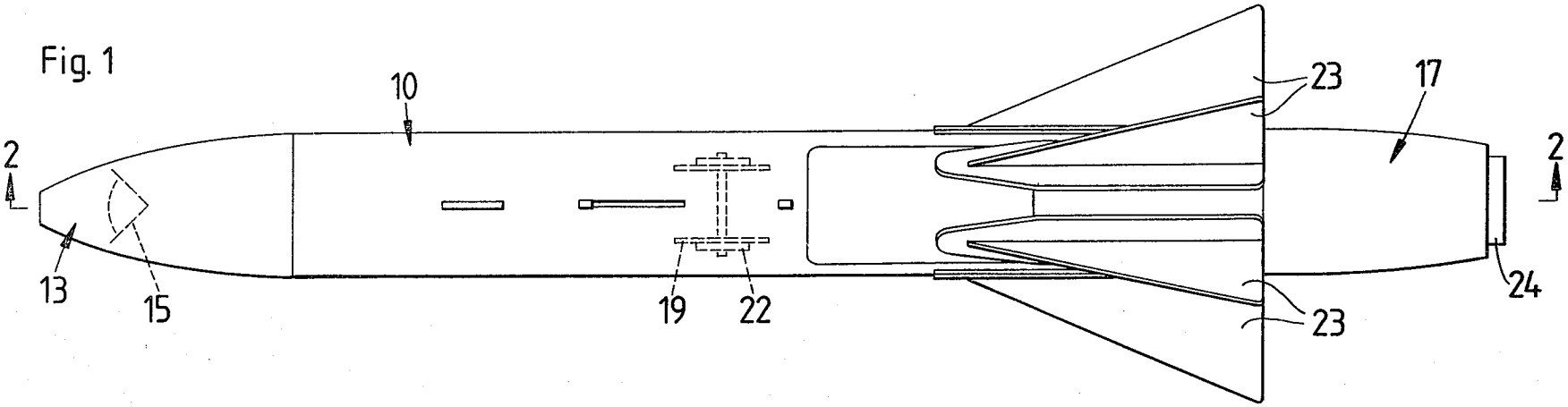
FIG. 1 is a top plan view showing my improved airborne target.
Figure 2:
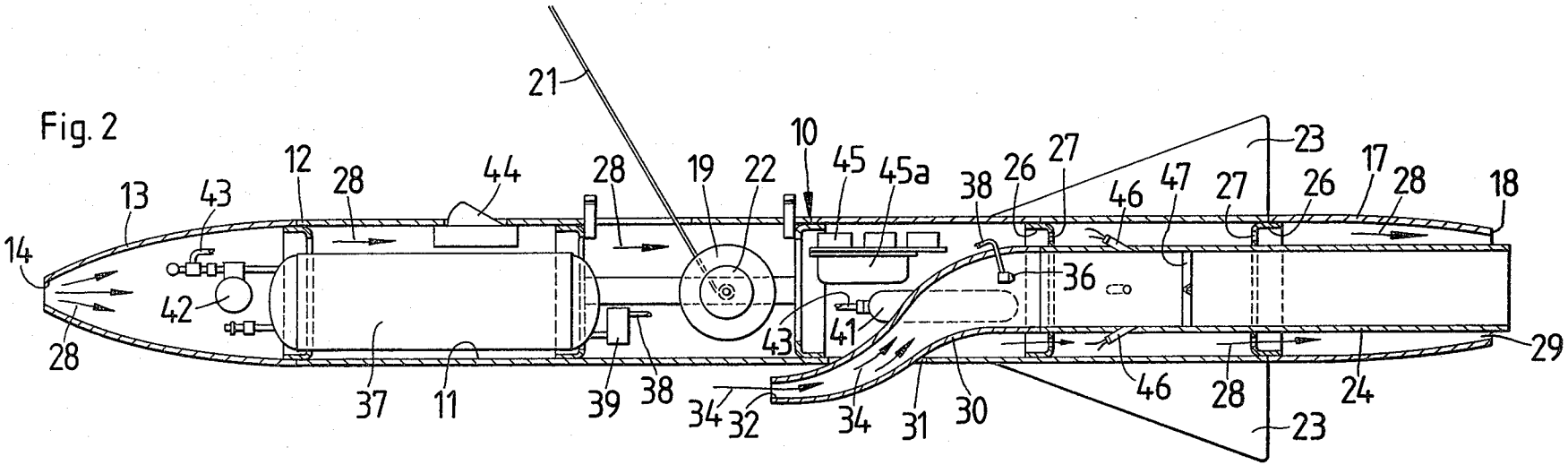
FIG. 2 is a sectional view taken generally along the line 2—2 of FIG. 1.
Figure 3:
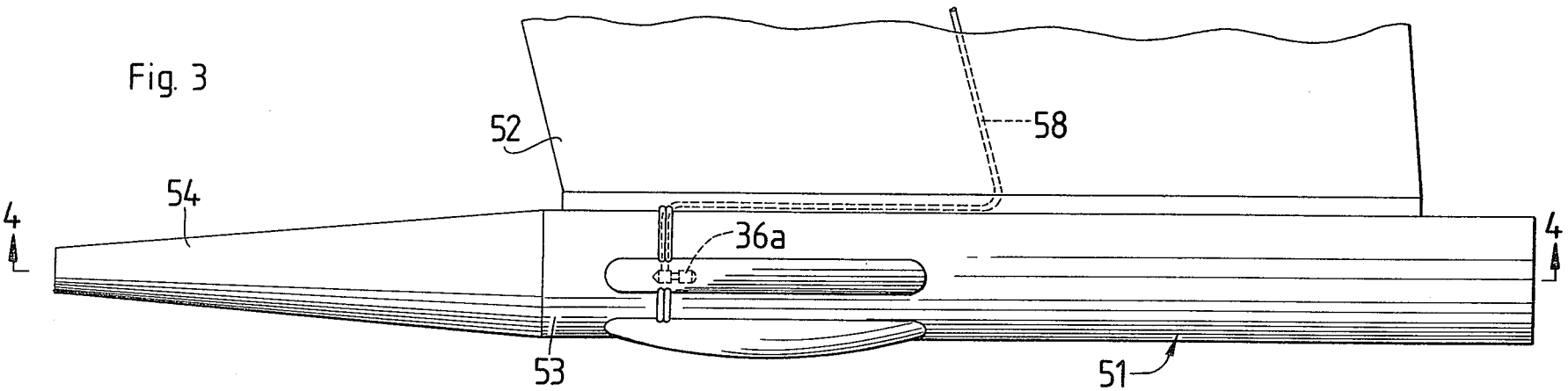
FIG. 3 is a top plan view showing another form of my improved airborne target mounted on the wing tip of a drone vehicle.
Figure 9:
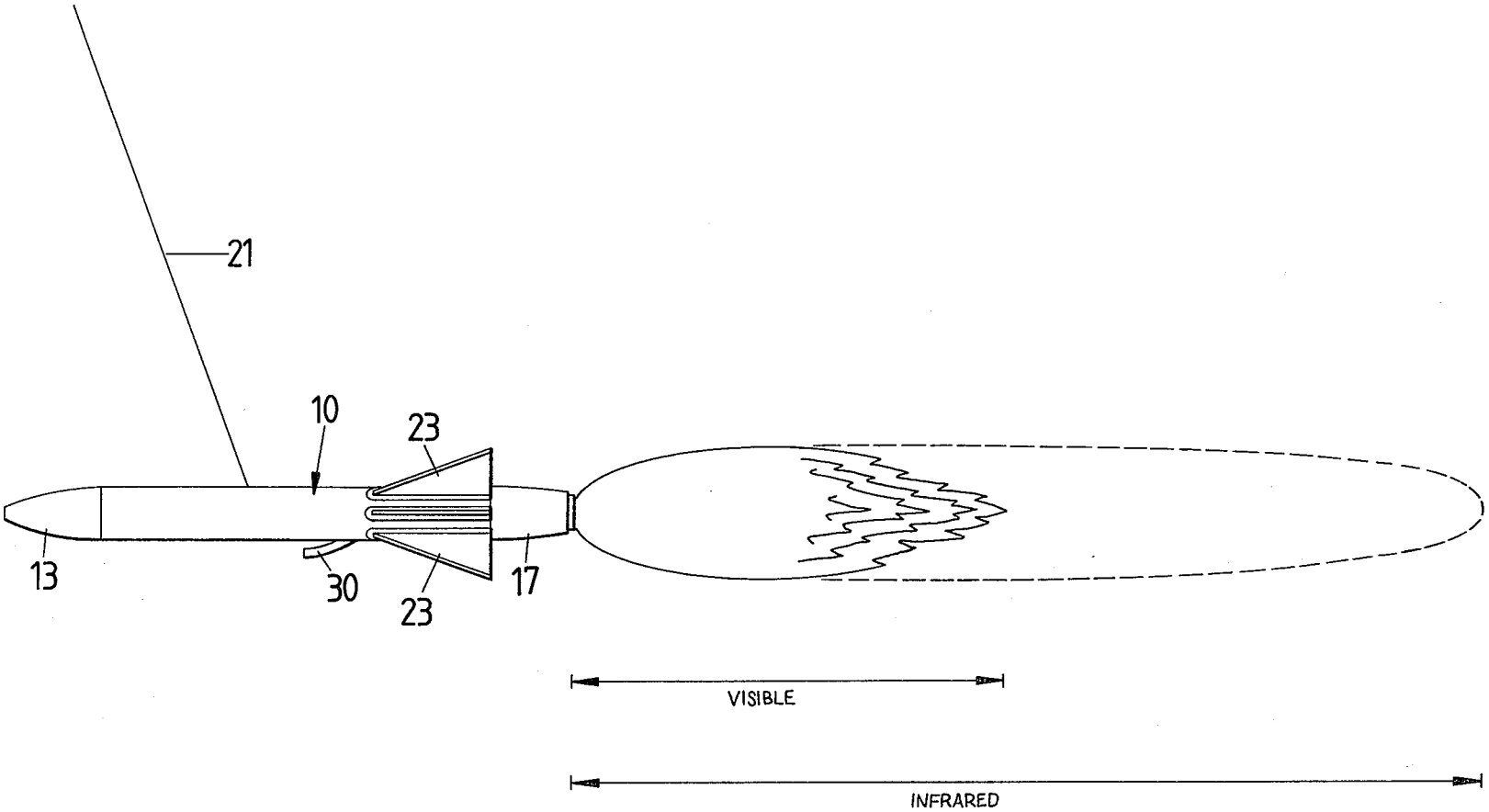

Referring now to the drawings for a better understanding of my invention, I show in FIGS. 1, 2 and 9 my improved airborne towed target for use in the exercise of high technology infrared guided weapons designed to home on the exhaust plume generated by a jet powered aircraft. My improved towed target comprises an elongated target body 10 which preferably is cylindrical in shape and defines an internal cylindrical cavity 11. Secured to the forwardmost end 12 of the body 10 is a nose cone 13 which is defined by a rearwardly flaring cone-shaped tubular member. As shown in FIG. 2, an opening 14 of a predetermined diameter extends through the forwardmost end of the nose cone 13 to permit air to flow therethrough and enter the cavity 11. Different types of radar reflectors, such as a triangular trihedron 15, may be carried by the nose cone 13 to enhance the radar characteristics of the towed target, as shown in FIG. 1. Carried by the rearmost end 16 of the body 10 is a tail cone 17 which is defined by a rearwardly tapering cone-shaped tubular member which terminates in a reduced diameter open end 18.

As shown in FIGS. 1 and 2, an internal tow reel 19 is carried by the body 10 and includes a prewound cable 21 which is automatically deployed when the target is launched. A reel brake 22 is carried by the reel 19 to control the reel-out speed of the cable 21 and prevent the target from breaking off when it reaches the end of the cable.

A plurality of angularly spaced, radially extending tail fins 23 are carried by the rear portion of the body 10 to aid in stabilizing the body as it is pulled through the air. Preferably, the target body 10, nose cone 13, tail cone 17 and tail fins 23 are constructed of a lightweight, high impact resistant thermoplastic material.

As shown in FIG. 2, an elongated cylindrical combustion chamber 24, which preferably is constructed of a heat resistant material such as stainless steel, is mounted within the rear portion of the cavity 11. A pair of spaced apart annular mounting brackets 26 are secured in place between the inner cylindrical surface of the body 10 and the outer surface of the combustion chamber 24 to hold the combustion chamber in axial alignment with the opening through the rear end 18 of the tail cone 17. A plurality of openings 27 are provided through each mounting bracket 26 to permit air flowing through the opening 14 in the nose cone 13 to flow adjacent the outer surface of the combustion chamber 24 and thus cool the same. The cooling air, as indicated by arrows 28, exits the target through an annular opening 29 defined between the outer surface of the combustion chamber 24 and the opening through the rear end 18 of the tail cone 17.

Secured to the forwardmost end of the combustion chamber 24 is the rear end of an offset, rearwardly flaring tubular member 30. The forward portion of the tubular member 30 extends downwardly and forwardly through an opening 31 provided through the body 10 and terminates in an open forward end 32. The open forward end 32 forms an air receiving inlet which permits streams of air, indicated by arrows 34, to flow through the tubular member 30 and enter the combustion chamber 24. The rearwardly flaring configuration of the tubular member 30 forms an expansion chamber for the streams of air 34 flowing through the air receiving inlet 32. That is, as the streams of air 34 flow through the air receiving inlet 32, the shape of the tubular member 30 causes the air to expand concomitantly with the reduction in its velocity prior to its entry into the combustion chamber 24. The expansion chamber formed by the rearwardly flaring tubular member 30 also causes the pressure of the air flowing therethrough to increase a predetermined amount just prior to its entry into the forwardmost end of the combustion chamber 24.

As shown in FIG. 2, a fuel injection nozzle 36 is mounted within the rear portion of the tubular member 30. The fuel injection nozzle 36 is adapted to inject hydrocarbon fuel, such as jet fuel JP-4, at a predetermined rate into the streams of air 34 flowing into the combustion chamber 24 to thus form a predetermined fuel-air mixture. Mounted in the forward portion of the elongated body 10 is a fuel storage tank 37 which communicates with the fuel injection nozzle 36 through a fuel supply line 38 and an electrically operated solenoid valve 39. A pressurized nitrogen tank 41 is carried by the body 10 for pressurizing the fuel tank 37 and for pumping the fuel through the solenoid valve 39 to the injection nozzle 36. A conventional pressure regulating valve assembly 42 is mounted adjacent the forward end of the fuel storage tank 37 and communicates through a line 43 with the nitrogen tank 41 to regulate the pressure within the fuel storage tank. While the target is carried underneath its towing or carrier aircraft prior to being launched, a mechanically operated launch safety switch assembly 44 controls all target power, thus deactivating the solenoid valve 39 and preventing the flow of jet fuel to the fuel injection nozzle 36. After the target is launched, the safety switch assembly 44 closes, thus applying power to all target systems.

As shown in FIG. 2, a battery pack 45 is carried by the body 10 to supply power to the electrical system of the towed target. That is, the battery pack 45 provides electrical power through the launch safety switch 44 to operate a remote control receiver 45$^a$, solenoid valve 39, and the igniters indicated at 46. The battery pack 45 thus energizes the remote control receiver 45$^a$ which actuates the solenoid valve 39 upon command and a timer, not shown, to fire the igniters 46 a few seconds after fuel is injected through the fuel injection nozzle 36.

Figure 8:
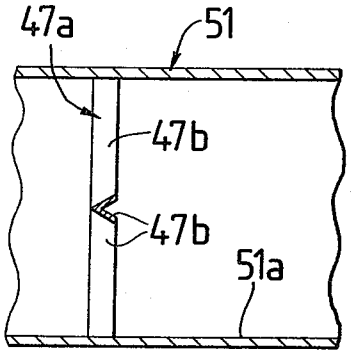
FIG. 8 is a fragmental, sectional view taken generally along the line 8—8 of FIG. 7; and, FIG. 9 is a side elevational view of my improved towed target shown in FIGS. 1 and 2 in flight with the visible and infrared characteristics of its exhaust plume illustrated in solid and dotted lines, respectively.
Figure 7:
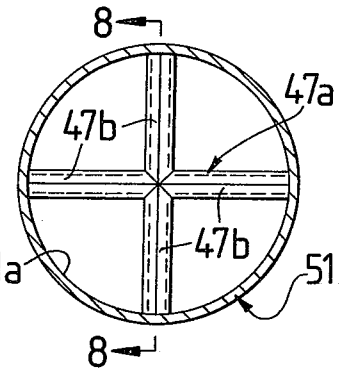
FIG. 7 is an enlarged sectional view taken generally along the line 7—7 of FIG. 4.

As shown in FIG. 2, a plurality of igniters 46 are carried by the combustion chamber 24 downstream of the injection nozzle 36 and are spaced angularly relative to each other. The igniters 46 are preferably electrically operated, one-shot pyrotechnic devices which ignite the fuel-air mixture flowing through the combustion chamber 24. After ignition, the burning mixture attaches to a flame holder 47 mounted on the mid portion of the combustion chamber 24. As shown in FIGS. 7 and 8, the flame holder 47 is preferably formed from elongated members which are angle-shaped as viewed in cross section and cross each other at the longitudinal center of the combustion chamber to provide sustained burning of the ignited fuel-air mixture after the igniter is spent. As shown in FIG. 8, the legs of the angle-shaped members flare outwardly and rearwardly away from each other in the direction of flow of the burning mixture. Accordingly, as the burning mixture flows alongside the outer surface of each leg of the angle-shaped members, eddy currents are formed between the free ends of the legs of each angle-shaped member. This causes the flame to attach to the flame holder 47 and maintain combustion of the mixture. Since this type arrangement does not provide complete combustion of the fuel-air mixture within the combustion chamber 24, the unburned portion of the fuel-air mixture exits the target body and ignites as it enters the atmosphere to form an exhaust plume which simulates the exhaust plume of a jet powered aircraft. The ignition of the fuel-air mixture within the combustion chamber 24 increases the velocity of the mixture so that it equals substantially the velocity of the external slip stream. Accordingly, the remaining unburned portion of the fuel-air mixture which exits the target body ignites with outside air to create an exhaust plume which has essentially zero thrust and simulates the visible and infrared characteristics of the exhaust plume of a jet powered aircraft. The visible and infrared plume length created by the unburned portion of the fuel-air mixture igniting with the outside air depends upon the particular portion of the infrared spectrum being considered, the physical properties of the specific plume generator involved and the fuel flow rate employed to inject fuel under pressure into the streams of air flowing through the expansion chamber 30. For example, a five inch diameter combustion chamber as illustrated in the towed target shown in FIGS. 1, 2 and 9 will produce, at a predetermined altitude, air speed and fuel flow rate, an exhaust plume of a length of approximately 6 feet in the visible spectrum and approximately 13 geet in the four to five micron band of the infrared spectrum.

From the foregoing description, the operation of my improved airborne towed target as shown in FIGS. 1, 2 and 9 will be readily understood. While my improved towed target is attached to an airborne towing aircraft, the launch safety switch 44 maintains the solenoid valve 39 in closed position. After the target is launched, a radio signal is sent to the remote control receiver 45$^a$ to cause the solenoid valve 39 to be opened whereby it permits jet fuel to flow at a predetermined rate under pressure through the fuel line 38 to the fuel injection nozzle 36. A few seconds after jet fuel is injected into the streams of air 34 flowing through the combustion chamber 24, an igniter 46 is fired to ignite the fuel-air mixture and quickly heat the flame holder 47. After the flame holder 47 reaches a predetermined temperature, the burning mixture attaches to the flame holder and provides sustained burning of the fuel-air mixture after the igniter is spent. Since most of the fuel-air mixture is not burned within the combustion chamber 24, it flows rearwardly out the rear end of the combustion chamber and ignites with outside air to form an exhaust plume which has essentially zero thrust and simualtes the visible and infrared characteristics of the exhaust plume of a jet powered aircraft.

Figure 4:
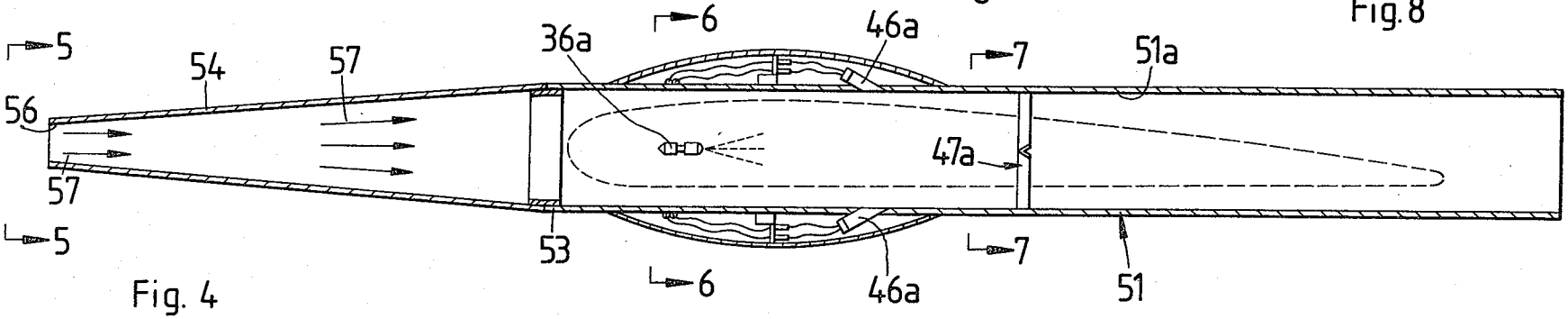
FIG. 4 is a sectional view taken generally along the line 4—4 of FIG. 3.

Referring now to FIGS. 3–8, I show another form of my improved airborne infrared target. This form of my improved target embodies an elongated tubular housing 51 which is mounted on the wing tip 52 of a powered drone vehicle. The passageway through the tubular housing 51 defines a combustion chamber 51$^a$ which is substantially identical in structure to the combustion chamber 24 described above with the first embodiment. Secured to the forwardmost end 53 of the tubular housing 51 is a nose cone 54 which preferably is in the shape of an elongated, rearwardly flaring tubular member. As shown in FIG. 4, the nose cone 54 is in axial alignment with the longitudinal center of the combustion chamber 51$^a$ and has an open forward end which defines an air receiving inlet 56. The rearwardly flaring walls of the nose cone 54 form an expansion chamber which causes streams of outside air flowing through the inlet 56, as indicated by arrows 57, to expand at a predetermined rate as they move toward the combustion chamber 51$^a$. The construction of the nose cone 54 also reduces the velocity of the air while at the same time increases its pressure to a predetermined amount just prior to its entry into the combustion chamber 51$^a$.

Mounted in the forward portion of the combustion chamber 51$^a$ is a fuel injection nozzle 36$^a$ which injects hydrocarbon jet fuel, such as jet fuel JP-4, at a predetermined rate into the streams of air 57 to form a predetermined fuel-air mixture. The nozzle 36$^a$ communicates through a fuel supply line 58 with a fuel storage system carried by the drone vehicle and is substantially identical in structure to the nozzle 36 described above relative to my first embodiment.

Figure 6:
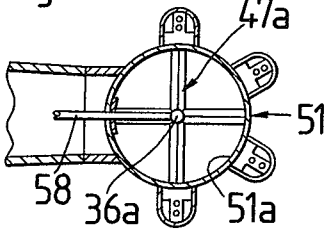
FIG. 6 is a fragmental, sectional view taken generally along the line 6—6 of FIG. 4.
Figure 5:
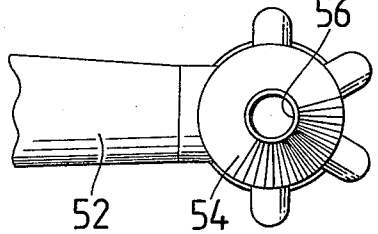
FIG. 5 is a fragmental front end view taken generally along the line 5—5 of FIG. 4.

As shown in FIGS. 4 and 6, a plurality of electrically operated igniters 46$^a$, such as pyrotechnic devices, are carried by the tubular housing 51 downstream of the fuel injection nozzle 36$^a$. A few seconds after jet fuel mixes with the streams of air 57 flowing through the forward portion of the combustion chamber 51$^a$, an igniter 46*a* is fired to ignite the fuel-air mixture. Upon ignition, the burning mixture heats up and attaches to a flame holder 47$^a$ in the same manner as described above relative to the first embodiment. The flame holder 47$^a$ is formed from a pair of angle-shaped bars 47$^b$ which cross each other at the longitudinal center of the combustion chamber to define a generally cross-shaped member, as shown in cross section in FIGS. 6 and 7. As the flame passes over the outer surfaces of the legs of each bar, eddy currents are set up between the free ends of the legs of the angle-shaped bars 47$^b$ which causes the burning mixture to attach to the flame holder. Since the rear portion of the tubular housing 51 is not provided with a reduced diameter exit nozzle, the velocity of the burning mixture is only increased slightly by its combustion in the chamber 51$^a$. This results in the burning mixture exiting the target body at a velocity which is substantially equal to that of the external slip stream. Accordingly, an exhaust plume which has essentially zero thrust and simulates the visible and infrared characteristics of the exhaust plume of a jet aircraft is created in the same manner as described above relative to the first embodiment.

From the foregoing, it will be seen that I have devised an improved airborne target which generates an exhaust plume having infrared energy characteristics that simulate the infrared energy characteristics of the exhaust plume of a jet powered aircraft. By providing a target body which burns the same jet fuel as a jet powered aircraft, I provide an airborne target which may be employed by military agencies in the use of high technology infrared guided weapons which are designed to home on the infrared rich content of the exhaust plume of jet powered aircraft. Also, by providing an airborne target wherein the fuel-air mixture burned therein may be easily changed or adjusted depending upon the altitude and speed of the target in flight, I provide a target which can produce infrared energy in various bands of the infrared spectrum generated by different types of jet powered aircraft.

While I have shown my invention in two forms, it will be obvious to those skilled in the art that it is not so limited, but is susceptible of various changes and modifications without departing from the spirit thereof, including the rearward attachment of metallic parts within the plume stream which are heated by the plume, thereby enabling my invention to simultaneously simulate the black body and plume characteristics of a jet engine.

What I claim is:

1. An airborne target for generating an exhaust plume simulating that of a jet powered aircraft, comprising:

(a) an elongated target body carrying a longitudinally extending combustion chamber and having an air receiving inlet facing in the direction of travel of said body and in communication with the forwardmost end of said combustion chamber, with there being an outlet at the rearmost end of said combustion chamber for exhausting said plume, (b) means between said air receiving inlet and said forwardmost end of said combustion chamber for increasing the expansion of a stream of air flowing therethrough and for reducing the velocity thereof, (c) fuel injection means carried by said body in position to inject hydrocarbon fuel at a predetermined rate under pressure into said stream of air to provide a predetermined fuel-air mixture, (d) at least one igniter carried by said body for igniting said fuel-air mixture, and (e) a flame holder carried by said body rearwardly of said igniter in position for the ignited fuel-air mixture to attach thereto and provide sustained burning after the igniter is spent and produce an exhaust plume of a predetermined length which simulates the same spectral distribution of infrared energy as that produced from a jet engine burning the same fuel.

2. An airborne target as defined in claim 1 in which said means for increasing the expansion of said stream of air and reducing the velocity thereof comprises an elongated expansion chamber communicating with said forwardmost end of said combustion chamber.

3. An airborne target as defined in claim 2 in which said expansion chamber is a generally cone-shaped, rearwardly flaring tubular member in axial alignment with said combustion chamber.

4. An airborne target as defined in claim 3 in which said air receiving inlet is an opening of a predetermined size through the forwardmost end of said tubular member in alignment with said combustion chamber.

5. An airborne target as defined in claim 2 in which said expansion chamber is an offset, rearwardly flaring tubular member having its forward portion extending downwardly and forwardly through an opening in said body and terminating in an open forward end.

6. An airborne target as defined in claim 1 in which said fuel injection means is a spray nozzle carried by said body in position to inject said hydrocarbon fuel into the stream of air flowing through said combustion chamber.

7. An airborne target as defined in claim 1 in which a plurality of said igniters are carried by said body in angular spaced relation to each other down stream of said fuel injection means.

8. An airborne target as defined in claim 1 in which said flame holder is a pair of elongated angle members which cross each other adjacent the longitudinal center of said combustion chamber.

* * * * *

US004428583B1

REEXAMINATION CERTIFICATE (2806th)

United States Patent [19] [11] B1 4,428,583

Feagle [45] Certificate Issued Mar. 5, 1996

[54] AIRBORNE TARGET FOR GENERATING AN EXHAUST PLUME SIMULATING THAT OF A JET POWERED AIRCRAFT

[75] Inventor: Hugh B. Feagle, Leeds, Ala.

[73] Assignee: Hayes International Corporation, Birmingham, Ala.

Reexamination Request:
No. 90/002,388, Jul. 19, 1991

Reexamination Certificate for:

| | |
|---|---|
| Patent No.: | **4,428,583** |
| Issued: | **Jan. 31, 1984** |
| Appl. No.: | **443,056** |
| Filed: | **Nov. 19, 1982** |

[21] Appl. No.: 443,056

[51] Int. Cl.[6] ..... F41J 9/08; F41J 9/10

[52] U.S. Cl. ..... 273/348.1

[58] Field of Search ..... 273/359–365, 273/348.1; 244/3.16; 250/338.1, 342, 339

[56] References Cited

U.S. PATENT DOCUMENTS

| | | | |
|---|---|---|---|
| 2,647,365 | 8/1953 | Myers | 60/270.1 |
| 2,659,195 | 11/1953 | Bolanovich | 60/270.1 |
| 2,775,867 | 1/1957 | Collins | 60/270.1 |
| 2,778,191 | 12/1955 | Casey | 60/270.1 X |
| 2,835,109 | 5/1958 | Longwell | 60/270.1 |
| 2,859,588 | 11/1958 | Wilson | 60/270.1 |
| 2,995,896 | 8/1961 | King, Jr. et al. | 60/270.1 |
| 3,027,711 | 4/1962 | Rae | 60/270.1 X |
| 3,410,559 | 11/1968 | Miller et al. | 273/360 |
| 3,623,727 | 11/1971 | Regelson | 273/360 |
| 4,193,688 | 3/1980 | Watkins | 244/3.16 X |

OTHER PUBLICATIONS

D. Wyatt, "Jet Propulsion Engines," High Speed Aerodynamics and Jet Propulsion, vol. 12 (1959), pp. 268–297.

Excerpt from Aviation Week and Space Technology (Oct. 1979).

Technical Manual: Operation and Maintenance Instructions with Illustrated Parts Breakdown and Inspection Requirements, TDU–25/B Tow Target and Age (1968–1972).

Bonney et al., Principles of Guided Missile Design (1956), pp. 36, 40, 41, 324 and 325.

*Primary Examiner*—Paul E. Shapiro

[57] ABSTRACT

An airbrone target for generating an exhaust plume simulating that of a jet powered aircraft embodies an elongated target body having an elongated combustion chamber therein. An air receiving inlet which faces in the direction of travel of the body communicates with the forwardmost end of the combustion chamber. An expansion chamber between the air receiving inlet and combustion chamber increases the expansion of air flowing toward the combustion chamber while at the same time reduces its velocity. A fuel injector is carried by the body to inject hydrocarbon fuel at a predetermined rate under pressure into the air to thus provide a predetermined fuel-air mixture. An igniter is carried by the body downsteam of the fuel injector to ignite the fuel-air-mixture. A flame holder is carried by the body in position for the ignited fuel-air mixture to attach thereto and provide sustained burning after the igniter is spent. The sustained burning of the mixture thus produces an exhaust plume of a predetermined length which simulates the same spectral distribution of infrared energy as that produced from a jet engine burning the same fuel.

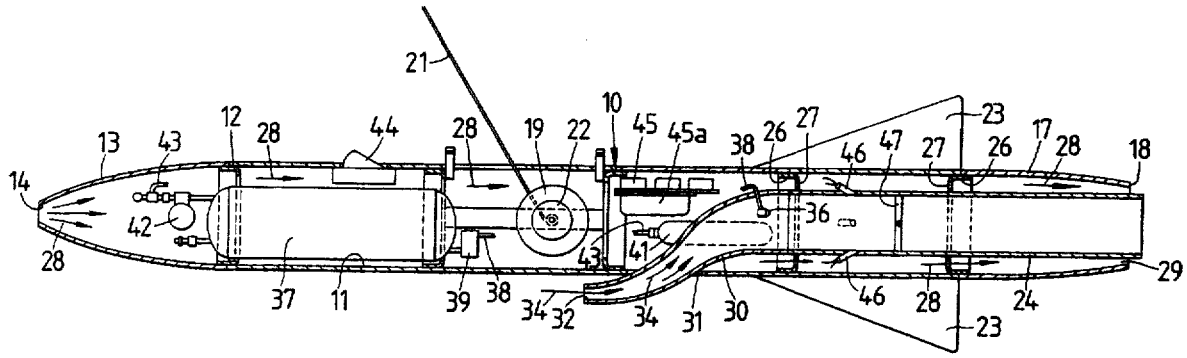

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–8 are cancelled.

* * * * *